United States Patent [19]

Halbert

[11] Patent Number: 4,726,504

[45] Date of Patent: Feb. 23, 1988

[54] PORTABLE SELF-PIERCING RIVETING APPARATUS

[75] Inventor: Eric H. Halbert, Cincinnati, Ohio

[73] Assignee: Senco Products, Inc., Cincinnati, Ohio

[21] Appl. No.: 30,498

[22] Filed: Mar. 27, 1987

[51] Int. Cl.[4] ..... B25C 1/04

[52] U.S. Cl. ..... 227/8; 72/453.17; 227/51; 227/130

[58] Field of Search ..... 72/325, 453.17; 227/8, 227/51, 52, 53, 61, 62, 63, 151, 152, 153, 124, 130

[56] References Cited

U.S. PATENT DOCUMENTS 3,111,869 11/1963 Goft et al. ..... 72/453.17 X
3,397,828 8/1968 Volkmann ..... 227/130
3,478,567 11/1969 Galutia ..... 227/61 X
3,711,006 1/1973 Conner ..... 227/61
4,515,302 5/1985 Davern et al. ..... 227/51 X

*Primary Examiner*—Paul A. Bell
*Attorney, Agent, or Firm*—Jerrold J. Litzinger

[57] ABSTRACT

A portable self-piercing riveting system includes a pneumatically driven driver which forces a self-piercing rivet through a workpiece. An anvil carried on a pivotal clamp is moved into operative alignment with the driver on the blind side of the workpiece to receive and set a rivet. The clamp is part of a linkage mechanism which moves the anvil into and out of operative position. When the anvil is in an operative position to receive and set a rivet, the linkage mechanism is in a locked position whereby the impactive force received by the anvil is not transmitted to an actuator for the linkage mechanism.

22 Claims, 12 Drawing Figures

PORTABLE SELF-PIERCING RIVETING APPARATUS

TECHNICAL FIELD

The invention relates generally to fasteners, and more particularly to a lightweight, portable tool for driving and setting self-piercing rivets. The invention will be specifically disclosed in connection with a pneumatically operated hand-held tool for driving and setting self-piercing rivets at a construction site or other temporary field location.

BACKGROUND OF THE INVENTION

In contemporary building construction, it is commonly necessary to fasten sheet metal components together at a construction site. For example, relatively thin sheet metal material is commonly used in building construction for wall studs, floor channels and joists, and these components, which are typically 0.020 to 0.060 inches in thickness, must be joined together. Presently, the most common method for securing these components is by self-drilling screws. Such self-drilling screws must be hand fed into a hand tool, and thereafter threadably advanced into the construction components. This procedure, particularly hand feeding the screws to the tool, is time consuming and inefficient. As a result, construction time and costs are unnecessarily increased.

Moreover, even after self-drilling screws are threadably driven into the construction components, they frequently function inadequately as fasteners. There are many reasons for such shortcomings. First of all, self-drilling screws tend to break relatively thin metal materials as they are advanced into the material. Furthermore, the effectiveness of a self-drilling screw as a fastener is dependent upon the technique and skill of the tool operator. Many times a tool operator will either underdrive or overdrive a screw. If underdriven the screw may be inadequately advanced into the joined components. Alternatively, if overdriven, the screw may be loose, allowing relative movement between the joined components.

Although self-drilling screws have a multitude of shortcomings, they are used extensively in actual practice since other prior art fastening systems have an even greater number of disadvantages for on-site applications. For example, nonself-drilling screws require the separate step of drilling a hole in the metal or other construction material prior to advancing the screw. Similarly, the hand held riveting tools of the prior art require preformed and aligned apertures in components to be joined or require the use of the so-called blind sided two piece rivets. Accordingly, these other fastening systems require additional cost, time, operator skill and equipment.

Self-piercing, single piece rivets are also well known in the art and have proved to be highly effective and efficient fastners for situations where both sides of the fastened workpiece are accessible. However, due to the substantial force required in driving a self-piercing rivet and the substantial impact received by the riveting tool when setting such rivets, prior art devices for driving and setting such single piece self-piercing rivets have been large, heavy and semi-permanently located in factories or other permanent locations. Hence, these self-piercing rivet devices have not proved suitable in the past for use at temporary or field construction sites.

SUMMARY OF THE INVENTION

Accordingly, it is a primary object of the present invention to provide a portable hand held-tool for driving and setting a single piece self-piercing rivet for fastening two or more components.

It is another object of the invention to provide a riveting tool which may be used for driving and setting a single piece self-piercing rivet at a temporary field location.

Another object of the invention is to provide a lightweight riveting tool for driving and setting single piece rivets.

Yet another object of the invention is to provide a portable riveting tool having a clamp mechanism for setting rivets, which clamp mechanism is movable to allow the tool to be properly positioned with respect to a workpiece.

A still further object of the invention is to provide a riveting tool for receiving and setting a prealigned and preoriented set of collated rivets.

Still another object of the invention is to provide a lightweight linkage and actuating mechanism arrangement for positioning a die and anvil on the blind side of a workpiece to set a self-piercing rivet wherein the linkage and mechanism arrangement will support the die and anvil against substantial impact force.

A still further object of the invention is to provide a riveting tool with a movable anvil for setting rivets on the blind side of a workpiece, which tool has a control system for ensuring that the anvil is properly positioned before a rivet is driven through the workpiece.

Additional objects, advantages and other novel features of the invention will be set forth in part in the description that follows and in part will become apparent to those skilled in the art upon the examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved riveting apparatus is provided. The apparatus includes a body containing a reciprocally movable driver adapted to drive a self-piercing rivet. The driver is driven by a driving means which is disposed within the body and which selectively applies an impactive force to the driver. A clamp which is pivotally secured relative to the body has an anvil mounted thereon for receiving a rivet driven by the driver. The anvil is moved in and out of alignment by pivoting the clamp mechanism. A self-piercing rivet is interposed between the driver and a workpiece positioned between the driver and the anvil. The riveting apparatus of the invention includes a trigger means for activating the driving means to initiate the application of an impactive force to the driver and further includes locking means for selectively opposing pivotal movement of the clamp against the impactive force applied by the driver.

In accordance with another aspect of the invention, the driving means includes a fluid operated piston reciprocally movable within the body. The driver is connected to the piston for common reciprocal movement therewith.

In accordance with another aspect of the invention, the piston is movable within a cylinder sleeve disposed at least partially within the body. A fluid storage chamber is disposed about the cylinder sleeve for storing a pressurized fluid to move the piston.

In one specific aspect of the invention, pivotal movement of the clamp is achieved by a plurality of links. The plurality of links includes a first link pivotally joined at one end to a pivotal axis fixed relative to the body. The opposite end of this first link is interconnected to a second link having its opposite end pivotally connected to the clamp. The interconnection between the second link and the clamp is about an axis noncoincident with the pivotal axis of the clamp.

In still another important aspect of the invention, the plurality of links serve as the locking means. The actuator is pivotally connected to the plurality of links about a pivotal interconnection between the first and second links. The actuator is operative to move the pivotal interconnection between the first and second links to effectuate movement of the clamp.

According to another important aspect of the invention, the first and second links are aligned so that each of the ends of the links are in co-linear relationship whenever the anvil is brought into alignment with the driver. When the first and second links are aligned in this way, any force applied to the anvil by the driver is not transmitted to the actuator.

In yet another aspect of the invention, a limit stop is provided for limiting movement of the actuator to a dead center position where the first and second links are aligned with their ends in co-linear relationship.

In still another aspect of the invention, the tool is provided with means for incrementally advancing a strip of collated rivets which are driven by the driver.

In accordance with another object of the invention, a control system is provided on a riveting tool which ensures that an anvil is properly positioned on the blind side of a workpiece prior to driving a rivet through the workpiece.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects, all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of this specification illustrates several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
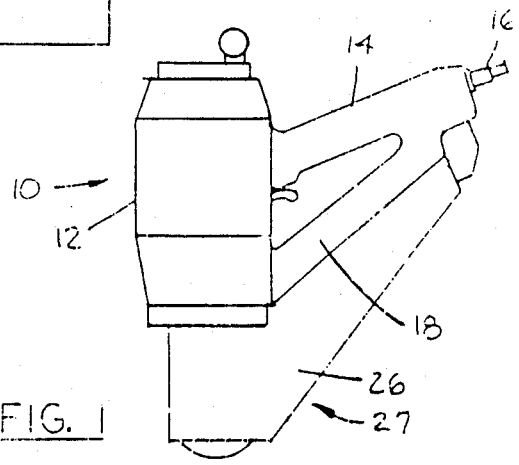
FIG. 1 is a schematic depiction of a portable hand held riveting tool constructed in accordance with the principles of the present invention.

Referring now to the drawings, the overall configuration of the illustrated embodiment is most readily apparent from the somewhat schematic representation of FIG. 1 which depicts a portable self-piercing rivet tool constructed in accordance with the principles of the present invention. As will be more fully explained in the description that follows, this tool 10 drives a single piece rivet through a workpiece and sets the rivet with a die and anvil positioned on the opposite or "blind" side of the workpiece.

Figure 2:
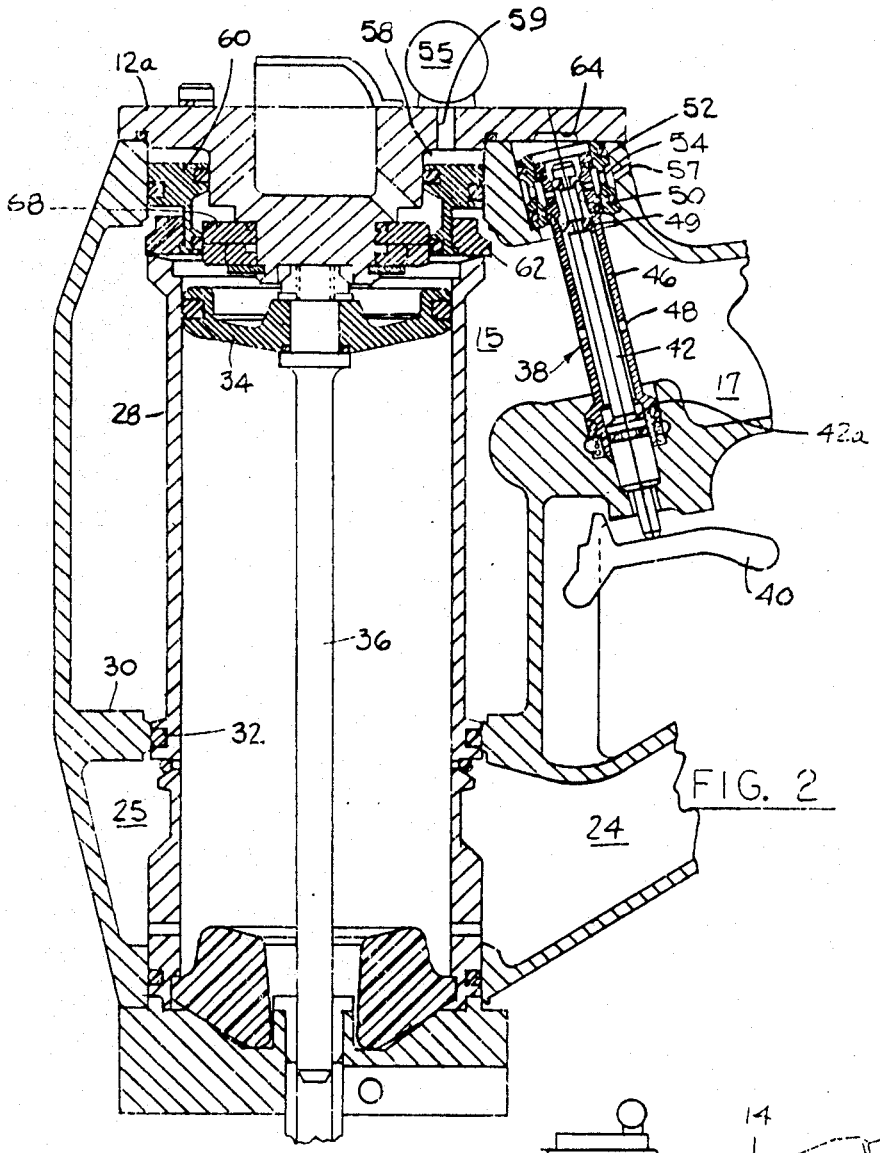
FIG. 2 is a fragmentary side elevational view of the riveting tool of FIG. 1, partially in cross-section, showing the driving section of the tool in a non-actuated position.

The illustrated tool 10 includes a hollow main housing 12 of generally cylindrical configuration. This housing 12 is joined by a hollow handle 14 extending radially outwardly from the housing 12. As seen in Fig. 2, the housing 12 and handle 14 include interconnecting internally disposed air storage chambers, air storage chamber 15 being disposed within the main housing 12 and air storage chamber 17 being disposed within handle 14. A connecting nipple 16 (FIG. 1) is secured proximal to the outboard end of the handle 14 (distal to the housing 12) for receiving an air hose to supply the tool 10 with compressed air.

With reference to both FIGS. 1 and 2, it will be appreciated that the compressed air supplied to the nipple 16 is directed into the interior air storage chamber 15 of the main housing 12 through the air storage chamber 17. A hollow handle extension 18 also extends radially outwardly of the cylindrical housing 12 from a location on the housing 12 directly beneath the handle 14. This handle extension 18 obliquely joins the handle 14 proximal to the outboard end of the handle 14.

As also apparent from FIG. 2, the hollow handle extension 18 also defines an internally disposed air storage chamber 24 which is in direct fluid communication with an air storage chamber 25 disposed within the lower portion of the main housing 12. Although not shown in the drawings, those skilled in the art will appreciate that the handle extension 18 includes an internally disposed partition for pneumatically separating the air storage chambers 17 and 24 at the outboard ends of the handle 14 and extension 18.

In the illustrated form of FIG. 1, the handle extension 18 also supports a pair of spaced downwardly depending guard plates 26 which shield (and partially obscure in FIG. 1) a linkage mechanism generally designated by the numeral 27. Shielding the linkage mechanism 27 in this manner is desirable to protect the tool operator against inadvertent insertion of his/her hand into the moving linkage mechanism 27. As will be apparent from the description of FIGS. 3–9 that follows, the linkage mechanism 27 functions to pivotally move a die and anvil into and out of an operating position for receiving and setting a rivet driven by the tool 10.

Once again focusing on FIG. 2, it may be seen that the main housing 12 contains the driving section of the rivet tool 10. More specifically, FIG. 2 shows a cylinder sleeve 28 spaced from and concentrically disposed within the internal walls of the main housing 12. It is this cylinder sleeve 28, in cooperation with the housing 12, that defines the internal air storage chambers 15 and 25. An annular boss 30 extends radially inwardly from the interior surface of the housing 12 toward the cylinder sleeve 28 to separate the upper air storage chamber 15 from the lower air storage chamber 25. In order to pneumatically seal these upper and lower air storage chambers 15,25 from each other, an O-ring seal 32 is fitted in an annular groove about the cylinder sleeve 28 in sealing contact with the boss 30.

In the illustrated embodiment, rivets are driven by a rod-like driver 36. The driver 36 is rigidly secured to the underside of a piston 34 which is reciprocally movable within the cylinder sleeve 28 under the impetus of a pressure differential across the piston 34. As those skilled in the art will appreciate from viewing FIG. 2, such a pressure differential is created by selectively positioning a remote control valve assembly 38 through the manual movement of a trigger 40.

The trigger 40 contacts a remote control valve core 42 which is longitudinally translatable within a remote control valve housing 46. This remote control valve housing 46 is concentrically spaced from and disposed about the core 42. In the depiction of FIG. 2, the core 42 is in a non-actuated position. In this non-actuated position, compressed air within the air storage chamber 17 enters the remote control valve housing 46 through a series of circumferentially spaced apertures 48. After being introduced into the housing 46, this compressed air applies a pressure on the lower shoulder 42*a* of the core 42 to urge the core 42 downwardly within the housing 46. When the core 42 is in the non-actuated position illustrated in FIG. 2, the O-ring seal 49 on the core 42 is in a non-sealing position with respect to the housing 46. In this position, pressure from air storage chamber 15 is transmitted about the O-ring 49 and through a circumferentially spaced series of apertures 50 in the upper portion of the housing 46. The upper portion of the remote valve housing 46 is also contained within a cage housing 52. This valve cage housing 52 has a further series of circumferentially spaced apertures 54 which are in fluid communication with a passageway 57 connected to a normally open valve 95, shown in FIGS. 4 and 5, used to control the tool's (10) sequence of operation and to ensure that the linkage 27 is in an operative position before the tool 10 is actuated. As will be apparent to those skilled in the art from the description that follows, pressure from the air storage chamber 15 is applied to the valve 95 to hold that valve 95 in a closed position so long as the remote control valve assembly is maintained in the FIG. 2 position.

An annular firing valve piston 60 is axially movable within an annular space 58 disposed above the cylinder sleeve 28. This firing valve piston 60 carries a firing valve washer 62 which is brought into and out of sealing relationship with the top of cylinder sleeve 28 in accordance with the axial movement of the firing valve piston 60. When the normally open pilot valve 55 is in the non-actuated position it applies air pressure to space 58 so that the firing valve washer 62 prevents air within air storage chamber 15 from entering the top of cylinder sleeve 28. Moreover, air pressure within air storage chamber 15 applies a sealing pressure against the firing valve washer 62 to maintain that sealing relationship.

Figure 3:
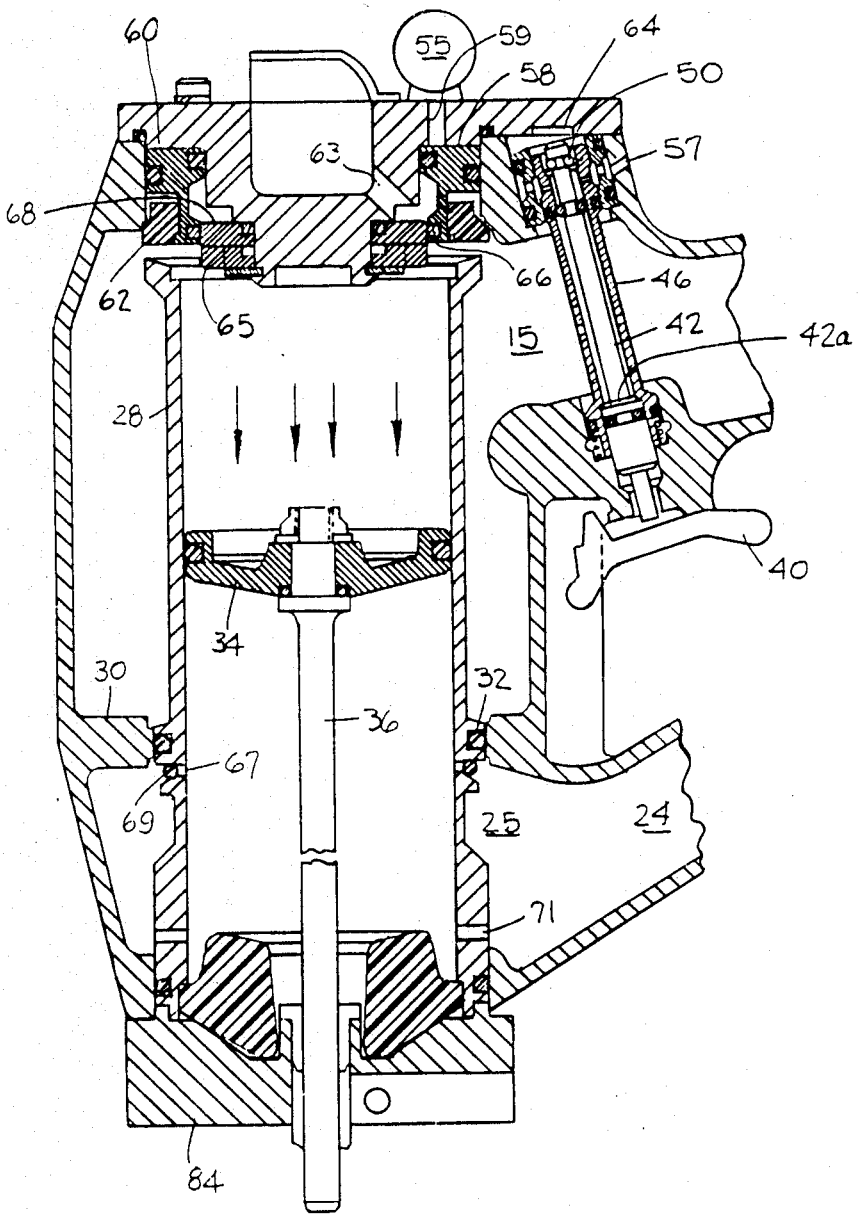
FIG. 3 is a fragmentary cross-sectional view similar to FIG. 2, but showing the driving section of the tool in an actuated position after the trigger has been activated.

When the manual trigger 40 is pulled, as shown in FIG. 3, the valve core 42 is urged upwardly within the remote valve housing 46. Such movement brings both the core shoulder 42*a* on the lower portion of the valve core 42 and the O-ring 49 on the upper portion of the valve core 42 into sealing contact with the housing 46. Furthermore, the O-ring 51, on the upper portion of the core 42, is unseated by this movement. As a consequence of such movement, the valve 95 is isolated from the air storage chamber 15 and the pressure previously applied to that valve 95 through passageway 57 is vented past the O-ring 51 to the ambient atmosphere through a milled groove 64 in the cap 12*a* of the main housing 12. Hence, valve 95 then moves to its normally open position permitting a pressurized air supply to be applied to a single acting piston-cylinder actuator 90 (see FIG. 4). Prior to the application of the pressurized air supply, the actuator 90 is held in a "collapsed" or retracted position by its internal return spring (not shown). As explained below in greater detail, the piston rod 94 of the actuator 90 is extended in response to the air pressure to contact a normally closed sensing valve 92, which valve 92 is opened to apply air pressure to a three-way valve 55 mounted on top of the main housing 12.

In its normally open position, the valve 55 puts the annular chamber 58 in fluid communication with the air storage chamber 15 through an opening 59 in that chamber 59 to urge the firing piston 60 to FIG. 2 position. When valve 92 is moved to its open position in response to contact from the extended actuator 90, it applies pressure to valve 55. The valve 55 is then shifted to exhaust the pressure annular space 58 to the atmosphere, eliminating the fluid pressure which holds firing piston 60 in the FIG. 2 position.

With the pressure within chamber 58 removed, the compressed air in air storage chamber 15 surrounding the piston 60 urges that piston 60 upwardly to the position shown in FIG. 3. Compressed air thus flows rapidly into the main bore of cylinder sleeve 28 forcing the piston 34, and its attached driver 36, downwardly. It will be further noted from FIG. 3 that the firing piston 60 further includes an exhaust valve seal 66 which is moved into sealing relationship with an exhaust valve 68 when the firing piston 60 is moved upwardly. This prevents compressed air within the storage chamber 15 from flowing under the firing valve washer 62 through passage 63 to the ambient exhaust.

It will be further noted from FIGS. 2 and 3 that the cylinder sleeve 28 has a plurality of circumferentially spaced apertures 67 below the rib supported O-ring seal 32. An O-ring check valve 69 is fitted over these apertures 67. As the piston 34 travels past the apertures 67, air pressure in the top of the cylinder sleeve 28 resiliently stretches the O-ring 69 to allow such pressurized air to pass into adjoining air storage chambers 24 and 25.

It will thus be appreciated that the movement of manual trigger 40 allows a sudden application of pressure against the top of piston 34 to urge that piston, and its attached driver 36, downwardly with considerable force. Once trigger 40 is released, air pressure in the space between the remote valve core 42 and remote valve housing 46 will be applied against core shoulder 42a to urge the valve core 42 back to the non-actuated position of Fig. 2. This will then once again apply pressure to the valve 95 (FIG. 4) causing piston 94 to retract under the influence of the internal return spring (not illustrated) within actuator 90. Valve 92 is also moved to its normally closed position (by reason of the retraction of piston 94) interrupting air pressure to valve 55. The valve 55 then returns to a position placing annular chamber 58 in communication with air storage chamber 15. Pressure is then applied to the top of annular space 58 to move the firing piston 60 back to the FIG. 2 position sealing the bore of cylinder sleeve from the air storage chamber 15. This movement of the firing piston 60 further moves the exhaust valve seal 66 to an exhaust valve spacer 65. The exhaust valve spacer 65 includes a number of semi-circular recesses about its periphery to place the top portion of the cylinder sleeve bore (above the piston 34) in fluid communication with ambient exhaust passage 63.

Furthermore, when the pressure above piston 34 is exhausted, the air stored in adjoining air storage chambers 24 and 25 passes through aperture 71 to urge the piston 34 upwardly. Hence, the pressurized air used to activate the tool 10 and drive piston 34 downwardly is transferred to air storage chambers 24,25 and used to return the piston 34 to the non-actuated position.

Figure 4:
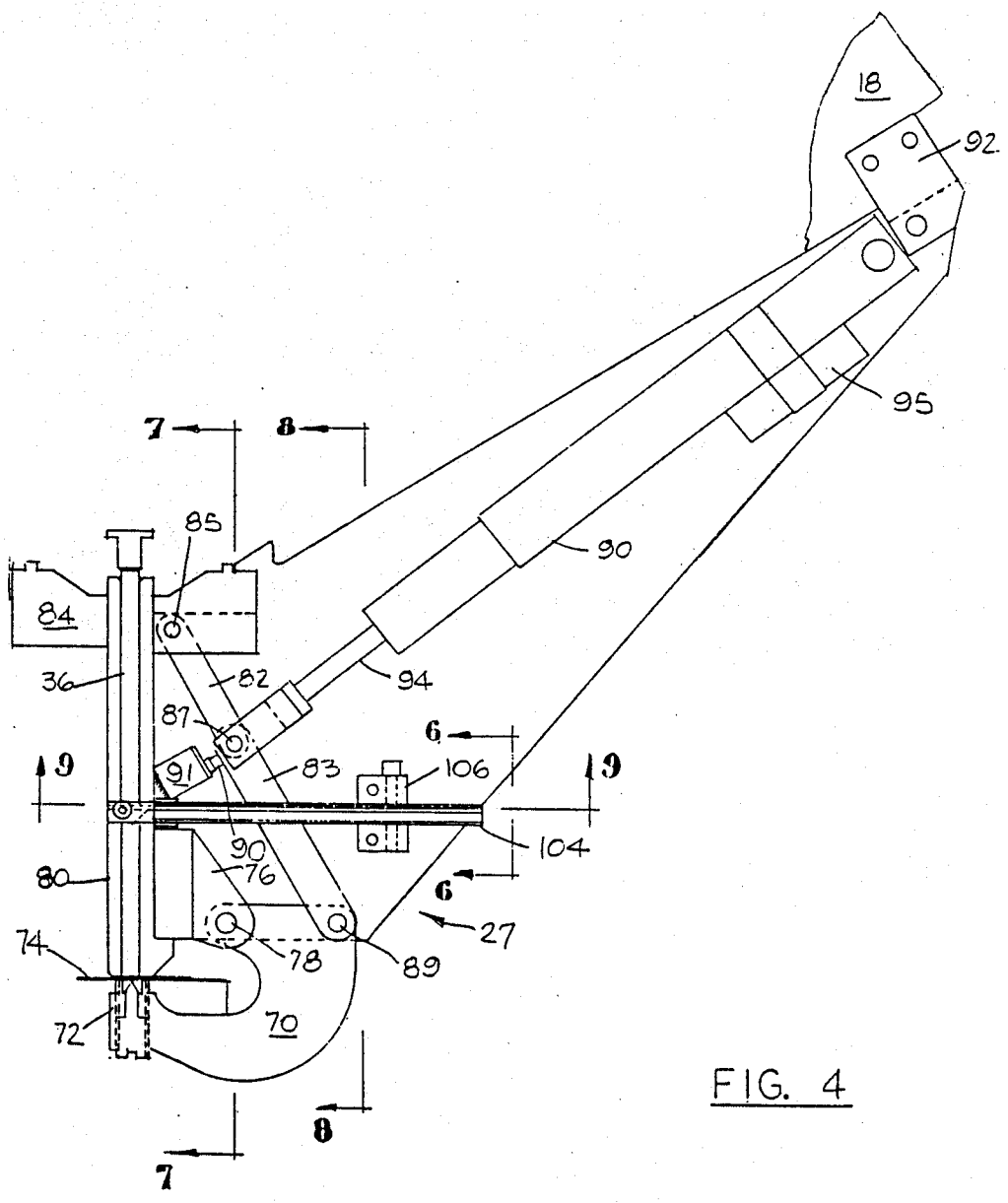
FIG. 4 is a further fragmentary side elevational view of the tool of FIG. 1 with one of the side plates removed depicting a linkage and clamp mechanism for receiving rivets on the blind side of a workpiece.

Turning now to FIG. 4, the linkage mechanism 27 is shown in greater detail. It will be seen that the illustrated mechanism 27 includes a pneumatically operated clamp 70 carrying a die and anvil 72 for forming a rivet driven through a workpiece 74 by the driver 36. The clamp 70, which is one link of a four-bar linkage, is pivotally mounted to a clevis 76 about a pivot pin 78, the clevis 76 being rigidly mounted on a guide body 80. The guide body 80 is rigidly mounted in an adapter 84, which is in turn mounted to the lower axial end of the main housing 12. The guide body 80 is, in effect, another link in the four-bar linkage system employed by the preferred embodiment. The die and anvil 72 are adjusted individually toward and away from the guide body 80 for proper clamping of various work thicknesses and proper setting of rivets of varying lengths.

Figure 8:
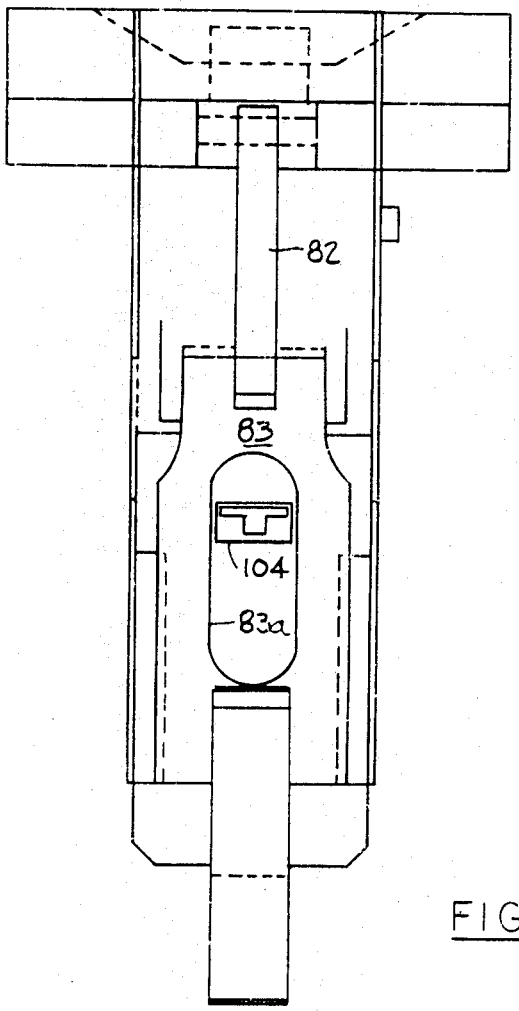
FIG. 8 is a view of the linkage mechanism taken along line 8—8 in FIG. 4.

In addition to the links formed by clamp 70 and the guide body 80, the linkage mechanism 27 includes links 82 and 83. The link 82 is pivotally joined to the adapter 84 (rigidly mounted with respect to the guide body 80) about a pin 85 at one end and pivotally joined to the link 83 at the opposite end about a pivot pin 87. The end of link 83 distal to the link 82 is pivotally interconnected to the clamp 70 about a pivot pin 89, the axis of pivot pin 89 being non-coincident to the axis of pivot pin 78 about which the clamp 70 is pivotally movable. As shown in FIG. 8, the link 83 has a centrally disposed opening 83*a*.

The pneumatically operative piston cylinder arrangement 90 is pivotally connected by a bracket 92 positioned near the outboard end of the handle extension 18. As previously suggested, this piston cylinder arrangement 90 selectively advances and retracts a piston rod 94 connected to pivot pin 87 interconnecting links 82 and 83. As readily apparent from a comparison of FIGS. 4 and 5, the retraction and advancement of the piston rod 94 moves the clamp 70 between a first non-actuated position (FIG. 5) and a second actuated position (FIG. 4).

Significantly, when the piston rod 94 is in its fully extended position, as depicted in FIG. 4, the anvil 72 is positioned beneath and aligned with the driver 36. According to one aspect of the invention, the elongated links 82 and 83 are also aligned in this actuated position. In other words, whenever the anvil 72 is positioned to accept a rivet driven by driver 36 through a workpiece 74, the pin 87 is in a "dead center" position with the pivotal pins 85, 87 and 89 in co-linear relationship. As a consequence of this arrangement, the entirety of any force received by the anvil 72 from the impact of driver 36 will be directed along a line of action defined by the pivot pins 89, 87 and 85, and none of the force will be directed against the piston cylinder actuator 90. Hence, a relatively small, lightweight actuator 90 may be advantageously employed in the tool 10.

Figure 5:
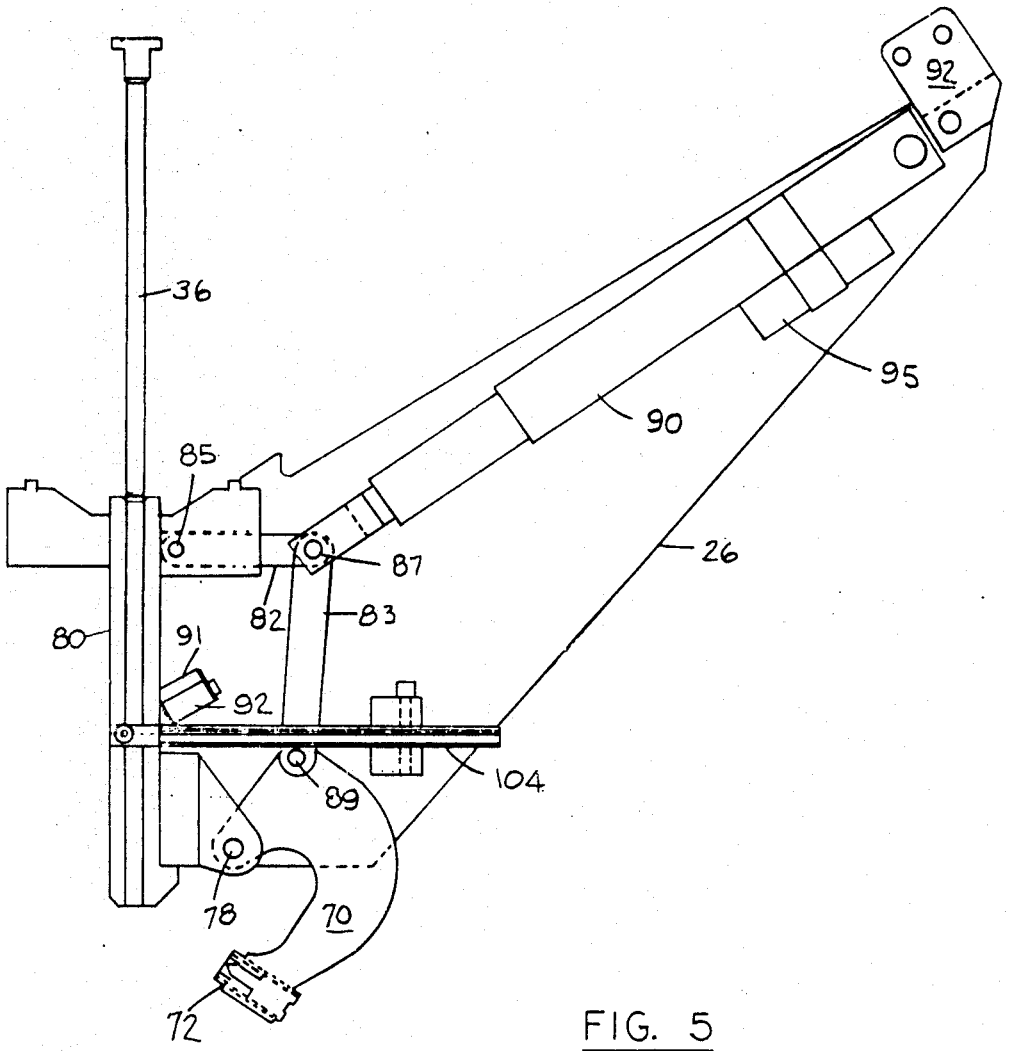
FIG. 5 is a side elevational view similar to FIG. 4, but showing the clamp and linkage mechanism in a non-actuated position.
Figure 7:
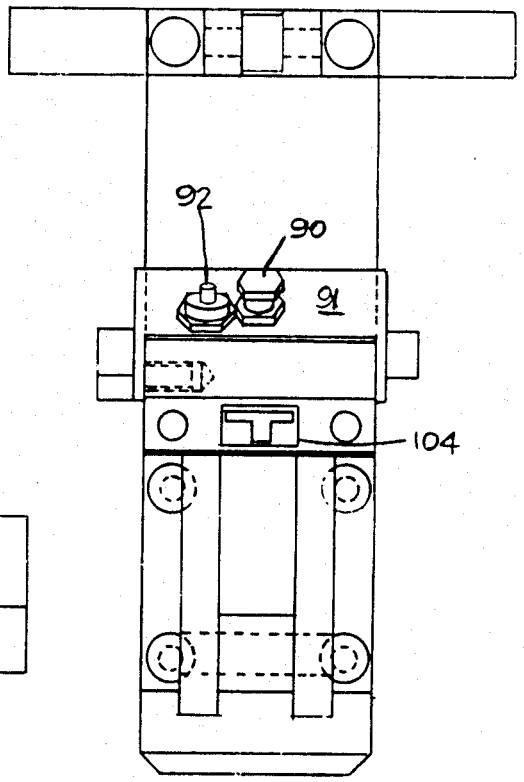
FIG. 7 is a sectional view taken along line 7—7 in FIG. 4 with the link members removed depicting a limit stop and position sensing valve.

As seen in each of FIGS. 4, 5 and 7, a limit stop 90 is provided to limit advancement of the piston rod 94 beyond the "dead center" position of FIG. 4. In the illustration, this limit stop is mounted on a bridge 91 rigidly secured to the guide body 80. As most readily apparent from FIG. 7, the bridge 91 for the limit stop 90 further includes the position sensing valve 92, which valve 92 is responsive to contact from the linkage mechanism 27. As previously explained, the position sensing valve 92 is a normally closed valve and is used to ensure that the driver 36 will not be fired until the anvil 72 is aligned with the driver in the operative position of FIG. 4.

Figure 6:
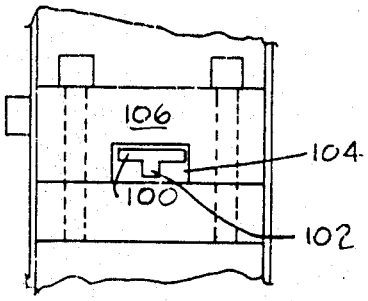
FIG. 6 is a cross-sectional view of a rivet rail guide taken along line 6—6 in FIG. 4.
Figures 9, 10, 11A, 11B:
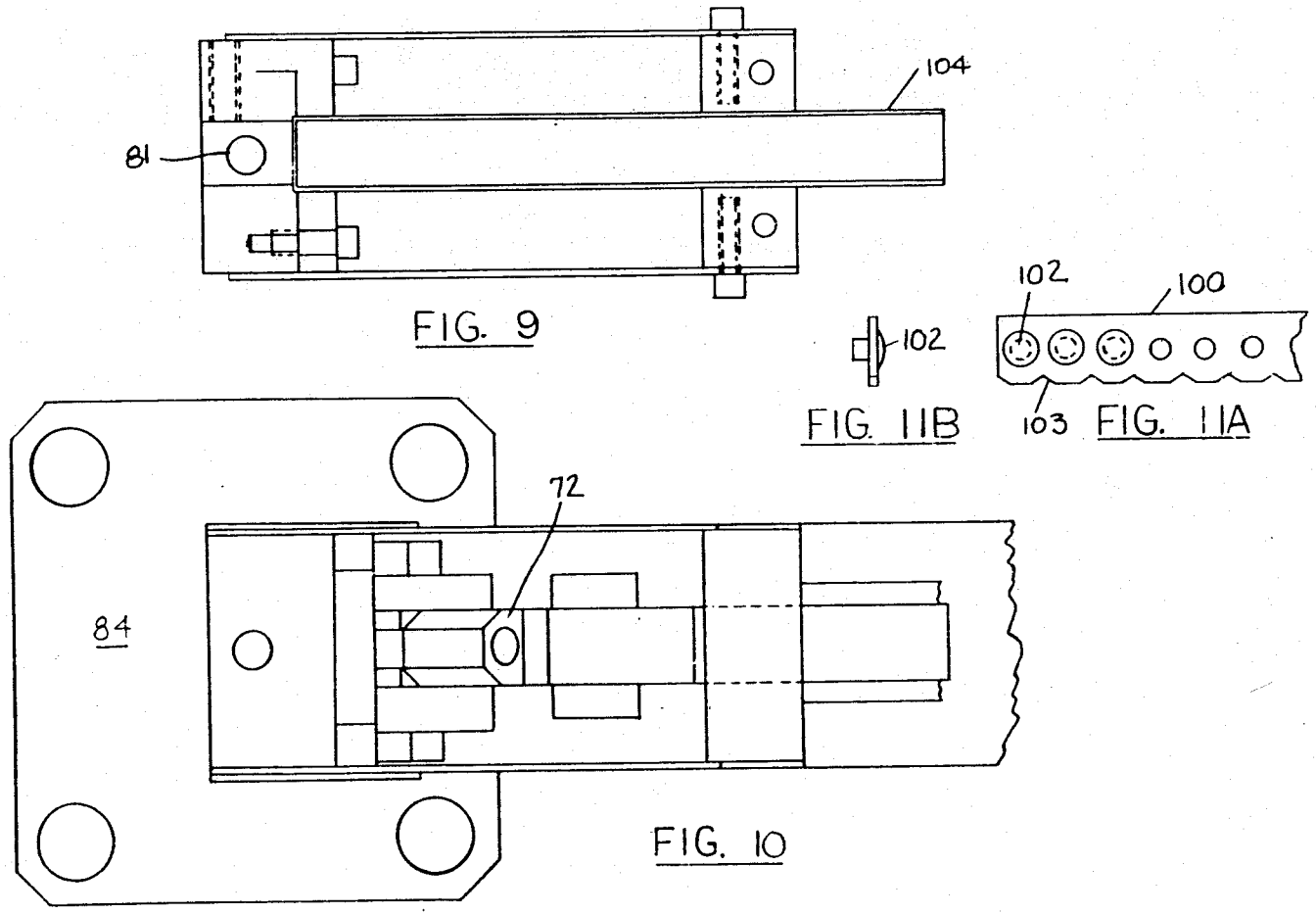
FIG. 9 is a sectional view of the rivet guide taken along line 9—9 of FIG. 4.
FIG. 10 is a fragmentary bottom plan view of the riveting tool of FIG. 1.
FIG. 11*a* is a plan view of a plastic collating strip containing a plurality of prealigned spaced rivets.
FIG. 11*b* is a side elevational view of the collating strip of FIG. 11*a*.

Turning now to FIGS. 11*a* and 11*b*, a plastic collating strip 100 containing a plurality of fixed prealigned and preoriented rivets 102 is shown. This collating strip 100 is advanced through a rivet rail guide 104, best seen in FIGS. 6 and 9. As also shown in FIG. 8, the rivet rail guide 104 extends through the opening 83*a* in link 83. A mounting block 106, as shown in FIGS. 6 and 9, secures this rivet rail 104 to one of the side guards 26. The guide rail 104 directs the collating strip 100 through an opening 81 in the guide body 80 into the movement path of the driver 36. When one of the rivets 102 is impacted by the driver 36, that rivet 102 is sheared from the strip 100 and pushed by the driver 36 through the guide body opening 81 to pierce the workpiece 74. After piercing the workpiece 74, the rivet 102 is set by the die and anvil 72 positioned on the blind side of the workpiece 74. Preferably, the strip incrementally is advanced into the driver path by an increment corresponding to the spacing of the rivets 102 in the strip 100. Toward this end, the side of strip 100 contains a series of notches 103 which cooperates with a pawl mechanism (not shown) to incrementally advance the strip 100 by the distance corresponding to the spacing between the rivets 102 in the strip.

In operation, the lower end of the guide body 80 is placed on a workpiece location to be riveted. When properly positioned, the operator compresses the manual trigger 40 (FIG. 2) to move the remote control valve core 42 upwardly in remote control valve housing 46. This terminates the supply of air from air storage chambers 15,17 to the normally open actuator valve 95. When the pressure applied to actuator valve 95 is terminated, that valve 95 directs pressurized air against the piston within piston-cylinder arrangement 90 to extend the piston rod 94 and to move the linkage mechanism 27 to the operative position shown in FIG. 4. When the linkage 27 depresses the normally closed position sensing valve 92, the valve 92 is opened to direct pressurized air to the three-way valve 55 on top of the cap 12*a*. This closes the valve 55 and allows pressurized air in annular space 58 above the actuated piston valve 60 to exhaust. The firing piston valve 60 is then moved upwardly and the driver 36 is fired. Controlling the firing sequence in this way ensures that the die and anvil 72 will be positioned to receive a rivet 102 whenever the driver 36 is fired.

In summary, numerous benefits have been described which result from employing the concepts of the invention. The riveting tool of the invention is relatively lightweight and may be used for driving and setting self-piercing rivets at field locations. Advantageously, the rivets may be prealigned and oriented in a plastic collating strip which is incrementally advanced through the riveting tool. The tool includes an anvil assembly which is movably positionable on the blind side of the workpiece to be riveted. This anvil assembly is carried on a pivotally movable clamp which is part of a four-bar linkage mechanism. An actuator is connected to the linkage mechanism at the pivotal interconnection between two of the links. When the anvil and die assembly is moved in an operative position in alignment with a driver of the tool, the two adjacent links to the actuator are in alignment so that the clamp is locked and none of the force applied to the anvil by the driver is transmitted to the actuator. Consequently, a relatively lightweight, light duty actuator may be used.

The foregoing description of a preferred embodiment of the invention has been presented for purposes of illustration and description. It is not intended to be exhaustive or to limit the invention to the precise form disclosed. Obvious modifications are possible in light of the above in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A portable self-piercing riveting apparatus, comprising:

(a) a body;

(b) a reciprocally movable driver adapted to drive a self-piercing rivet;

(c) driving means disposed within said body for selectively applying an impactive force to said driver for driving a self-piercing rivet through a workpiece;

(d) a clamp pivotally secured relative to said body;

(e) an anvil and die assembly securely mounted on said clamp for receiving a rivet driven by said driver;

(f) an actuator for selectively pivoting said clamp, said anvil and die assembly being moved into and out of alignment with said driver by the pivotal movement of the clamp;

(g) means for selectively interposing a self-piercing rivet between said driver and a workpiece positioned between said driver and said anvil;

(h) trigger means for actuating said driving means to initiate the application of an impactive force to said driver; and (i) locking means for selectively opposing the pivotal movement of said clamp against the impactive force applied by the driver.

2. A portable self-piercing riveting apparatus as recited in claim 1, wherein said driving means includes a fluid operated piston reciprocally movable within said body, said driver being connected to said piston for common reciprocal movement therewith.

3. A portable self-piercing riveting apparatus as recited in claim 2, wherein said piston is movable with a cylinder sleeve disposed at least partially within said body, a fluid storage chamber being disposed about said cylinder sleeve within said body for storing a pressurized fluid to move said piston.

4. A portable self-piercing rivet apparatus as recited in claim 2 wherein said body includes a guide having a passageway defining the movement path of said driver.

5. A portable self-piercing riveting apparatus as recited in claim 4 wherein the die and anvil assembly is adjustable with respect to said guide.

6. A portable self-piercing apparatus as recited in claim 5 wherein the die and anvil assembly includes a die and an anvil which are individually adjustable with respect to said guide.

7. A portable self-piercing riveting apparatus as recited in claim 4, wherein said rivet interposing means directs a rivet into the guide passageway.

8. A portable self-piercing riveting apparatus as recited in claim 7, wherein said rivet interposing means includes a collated strip of prealigned and preoriented rivets, said driver being operative to shear an individual rivet from the strip.

9. A portable self-piercing riveting apparatus as recited in claim 8, further including a guide rail guiding an individual rivet in the collated strip into the guide passageway of the driver.

10. A portable self-piercing riveting apparatus as recited in claim 1, wherein said locking means includes a plurality of pivotally interconnected links.

11. A portable self-piercing riveting apparatus as recited in claim 10, wherein said plurality of links includes a first link pivotally joined at one end to a pivotal axis fired relative to said body, the opposite end of said first link being interconnected to a second link having an opposite end pivotally connected to said clamp about an axis noncoincident to the pivotal axis of the clamp.

12. A portable self-piercing riveting apparatus as recited in claim 11, wherein said actuator is pivotally connected to said plurality of links about the pivotal interconnection between the first and second links, said actuator being operative to move said pivotal interconnection between the first and second links to effectuate pivotal movement of said clamp.

13. A portable self-piercing riveting apparatus as recited in claim 12, wherein the pivotal interconnection between first and second links is in colinear relationship with the fixed pivotal interconnection of the first link and the pivotal interconnection between the second link and the clamp when the anvil and die assembly is in alignment with the driver whereby force applied by the driver to the anvil and die assembly is not transmitted to the actuator.

14. A portable self-piercing riveting apparatus as recited in claim 13, further including a limit stop for limiting movement of the actuator in one direction to a position where the ends of the first and second links are in co-linear relationship.

15. A portable self-piercing riveting apparatus as recited in claim 1, further including control means for insuring that the anvil and die assembly is in alignment with said driver when an impactive force is applied to said driver.

16. A portable self-piercing riveting apparatus as recited in claim 15, wherein said control means includes means for sensing the locking of said clamp.

17. A portable self-piercing rivet system, comprising:

(a) enclosure means for storing a pressurized fluid;

(b) a cylinder disposed within said enclosure means, said cylinder and said enclosure means cooperating to define a fluid storage chamber about said cylinder;

(c) a piston reciprocally movable within said cylinder;

(d) a driver secured to said piston and reciprocally movable therewith;

(e) valve means for selectively establishing fluid communication between said fluid storage chamber and said cylinder to create a pressure differential across said piston to cause said piston to move within said cylinder;

(f) a driver guide externally disposed with respect to said enclosure means for defining a movement path for said driver, said driver guide having an inboard end secured relative to said cylinder and an outboard end distal to said cylinder;

(g) a clamp pivotally secured about a pivotal axis fixed relative to said driver guide, said clamp carrying an anvil and die assembly which is brought into and out of operative spaced alignment with the outboard end of said driver guide by the pivotal movement of said clamp, said anvil and die assembly and said driver guide being spaced in operative alignment to accommodate an interposed workpiece;

(h) a first link, one end of said first link being pivotally secured about an axis fixed relative to said driver guide;

(i) a second link, one end of said second link being pivotally secured to said clamp about an axis noncoincident with the pivotal interconnection of said clamp relative to said driver guide, the opposite end of said second link being pivotally interconnected to the end of said first clamp opposite to fixed interconnection of the first clamp relative to said driver guide;

(j) an actuator pivotally interconnected to the pivotal interconnection between the first and second links, said actuator being operative to pivotally move said clamp by moving the pivotal interconnection between the first and second links, said first and second links being arranged to bring each of the ends of the first and second links into co-linear alignment whenever the anvil is brought into operative alignment with the outboard end of said driver guide; and (k) control means for sequentially bringing said anvil and die assembly into operative alignment with the outboard end of said driver guide and creating a pressure differential across said piston to move said driver.

18. A portable self-piercing rivet system as recited in claim 17, wherein said actuator includes a pistoncylinder arrangement activated in response to said control system.

19. A portable self-piercing rivet system as recited in claim 18, wherein said control means includes means for sensing the co-linear alignment of said first and second links.

20. A portable self-piercing rivet system as recited in claim 17, further including a limit stop for limiting movement of the actuator in one direction to a position where the ends of the first and second links are in co-linear relationship.

21. A portable self-piercing rivet system as recited in claim 20, wherein one of said first and second links has an internal opening, and further including a rivet guide extending through said internal opening for supplying rivets into the path of said driver.

22. A portable self-piercing riveting system as recited in claim 21, further including a plurality of prealigned, spaced rivets collated in a strip, said strip being incrementally advancable within said rivet guide for positioning an individual rivet in the strip into the path of the driver.

* * * * *